United States Patent [19]

Mathews

[11] Patent Number: 4,615,126

[45] Date of Patent: Oct. 7, 1986

[54] FOOTWEAR FOR PHYSICAL EXERCISE

[76] Inventor: Dennis P. Mathews, 3909 Swiss Ave., Box 380, Dallas, Tex. 75204

[21] Appl. No.: 632,416

[22] Filed: Jul. 16, 1984

[51] Int. Cl.[4] ..... A43B 13/12; A43B 13/16; A43B 13/18

[52] U.S. Cl. ..... 36/102; 36/31; 36/25 R; 36/30 R; 128/585

[58] Field of Search ..... 36/31, 102, 103, 28, 36/43, 44, 30 R, 32 R, 114, 25 R, 88, 93; 128/584, 585, 586, 595

[56] References Cited

U.S. PATENT DOCUMENTS

| | | | |
|---|---|---|---|
| 334,668 | 1/1886 | Knipe | 36/25 R |
| 2,052,115 | 8/1936 | Shuman | 128/585 |
| 2,190,568 | 2/1940 | Lattemann | 128/586 |
| 2,193,704 | 3/1940 | Vaughn | 128/585 |
| 2,216,630 | 10/1940 | Sabel et al. | 128/584 |
| 3,003,501 | 10/1961 | Lynch | 128/586 |
| 3,594,929 | 7/1971 | Stohr | 36/44 |
| 3,738,373 | 6/1973 | Glancy | 128/585 |
| 3,766,669 | 10/1973 | Pearsall | 36/28 |
| 4,316,334 | 2/1982 | Hunt | 128/595 |
| 4,364,188 | 12/1982 | Turner et al. | 36/31 |
| 4,364,189 | 12/1982 | Bates | 36/31 |
| 4,506,462 | 3/1985 | Cavanagh | 36/30 R |

FOREIGN PATENT DOCUMENTS

| | | | |
|---|---|---|---|
| 220511 | 8/1961 | Austria | 36/43 |
| 660551 | 5/1938 | Fed. Rep. of Germany | 36/31 |
| 678001 | 7/1939 | Fed. Rep. of Germany | 36/25 R |
| 2751146 | 5/1979 | Fed. Rep. of Germany | 36/31 |
| 2806481 | 8/1979 | Fed. Rep. of Germany | 36/31 |
| 849255 | 11/1939 | France | 36/31 |
| 2522482 | 9/1983 | France | 36/31 |

*Primary Examiner*—Werner H. Schroeder
*Assistant Examiner*—Steven N. Meyers
*Attorney, Agent, or Firm*—W. Kirk McCord

[57] ABSTRACT

Improved footwear for physical exercise, such as running or jogging, in which a segment of the shoe extending beneath the third, fourth and fifth metatarsal-phalangeal joints on the lateral side of the shoe is comprised of a crepe or spongy rubber material, which is substantially more flexible than the material which comprises the remainder of the solepiece. This configuration reduces the resistance of the solepieces to the flexure of the foot along the third, fourth and fifth metatarsal-phalangeal joints, thereby reducing the stress on the corresponding foot muscles and allowing the stronger foot muscles which operate the first and second metatarsal-phalangeal joints on the medial side of the foot to do most of the work in flexing the foot during the running motion. As a result, the weaker muscles in the lateral side of the foot are not overly stressed and the direction of motion of the foot at the toe lift-off is substantially in the desired direction of running. In another aspect of the invention, an orthodic piece which is custom fit to the individual runner is provided to counteract foot problems, such as, for example, over-pronation, supination and high arch. The orthodic piece may be disposed inside the shoe or, alternatively, may be disposed between the bottom of the upper portion of the shoe and the midsole.

19 Claims, 16 Drawing Figures

FOOTWEAR FOR PHYSICAL EXERCISE

FIELD OF THE INVENTION

This invention relates to footwear and in particular to footwear used during physical exercise.

BACKGROUND OF THE INVENTION

The risk of injury has always been a problem for the athlete. Such injuries are not limited to contact sports such as football, but also frequently occur in non-contact sports such as running and jogging. Many people have become interested in jogging in recent years, as evidenced by the proliferation of community marathons and other long-distance races. Long-distance runners in particular have experienced many running-related injuries, which at the very least, interrupt their running activities and at the worst can prevent them from further engaging in serious running competition and lead to physical complications later in life. Perhaps the most serious of the running-related injuries is injury to the knee joint or the cartilage surrounding the knee joint. Such injuries are often caused by the twisting motion which accompanies the running cycle as the feet hit and push off from the ground.

Excessive pronation and supination are frequently causes of knee injuries. Pronation is the rotation of the foot from the "lateral" or outside portion thereof to the "medial" or inside portion. During the running cycle, the foot first hits the ground on the outer portion of the heel. The weight is then transferred to the forward portion to provide lift-off from the ground at the toes. Supination is the rotation of the foot from the medial to the lateral side. Rotation of the foot caused by either pronation or supination creates a twisting action on the knee, which may lead to serious injuries. Furthermore, this twisting action is exacerbated by the fact that in the conventional running shoe the initial push-off from the ground occurs along the metatarsal-phalangeal joints on the lateral side of the foot, thereby causing the foot to be directed outwardly from the desired direction of running.

Two basic approaches have been used to attempt to solve the problem of excessive pronation. One such approach involves building up the medial side of the shoe so that the medial side is slightly elevated with respect to the lateral side. Thus, during the running cycle, the elevated medial side of the shoe tends to counteract the natural rotation of the foot from the lateral side to the medial side. The medial side may be elevated either by building up the medial side of the support cushion on the inside of the shoe, or, alternatively, by elevating the medial side of the midsole of the shoe, as is shown in U.S. Pat. No. 4,180,924. The second basic approach involves providing a denser, firmer material on the medial side of the shoe to counteract pronation. For individuals having a problem with excessive supination, the shoe is built up on the lateral side.

Another problem often associated with conventional running shoes is that the shoe is too stiff and inflexible to allow the foot to properly bend for efficient lift-off from the ground. The need for a flexible show to provide for efficient bending of the foot during the running cycle must be balanced against the need for a sturdy, sufficiently cushioned shoe structure to absorb the impact of the feet hitting the ground during running.

U.S. Pat. No. 4,155,180 attempts to solve this problem by providing a running shoe in which the forward portion of the midsole and tread is much more flexible than the rear portion thereof to allow the forward portion to flex during lift-off from the ground. Although the flexibility of the shoe is somewhat enhanced, a substantial amount of force must still be exerted by the foot muscles, and in particular the foot muscles which bend the third, fourth and fifth metatarsal-phalangeal joints on the lateral side of the foot, to push off from the ground. As such, the efficiency of the runner is reduced and the foot muscles and joints on the lateral side of the foot are subject to overfatigue.

Another approach is shown in U.S. Pat. No. 4,262,435, wherein a flexure break segment of reduced thickness is provided on the solepiece along the metatarsal-phalangeal joint line. The segments are disposed along two intersecting lines, one of which extends between the first and second metatarsal-phalangeal joints and the second of which extends between the second and the fifth metatarsal-phalangeal joints. This enables each joint to flex indiviudually in accordance with the natural flexing action of the foot. Although the flexing action of the foot is somewhat enhanced by these segments of reduced thickness, the initial force needed to push off from the ground is still provided by the muscles on the lateral side of the foot, instead of the stronger muscles on the medial side thereof, resulting in a less efficient push-off from the ground and causing the foot to move outwardly from the desired running direction.

OBJECTS OF THE INVENTION

It is therefore one object of the present invention to provide improved footwear for running, jogging and other physical exercise.

It is another object of the invention to provide athletic footwear which allows the foot to push off more efficiently from the ground during athletic activity.

It is yet another object of the invention to provide an improved shoe for running and jogging which provides substantial protection against injury to the lower extremities of the body.

It is still another object of the invention to provide a running shoe which substantially counteracts the pronation of the foot during the running cycle.

It is a further object of the invention to provide athletic footwear which substantially reduces the workload of the muscles on the lateral side of the foot during athletic activity.

It is still a further object of the invention to provide athletic footwear which is customized to fit the individual wearer.

SUMMARY OF THE INVENTION

These and other objects are accomplished in accordance with the present invention whereby footwear for physical exercise is provided having a solepiece extending substantially along the entire length thereof, the solepiece including a ground-engaging bottom surface and a midsole portion for providing support for the foot. The solepiece further includes a discontinuity therein on the lateral side of the shoe for being disposed beneath selected ones of the metatarsal bones of the wearer, to enhance flexure of the solepiece along the joint line during physical exercise.

In one embodiment the discontinuity in the solepiece is disposed beneath the third, fourth and fifth metatarsal-phalangeal joints on the lateral side of the foot. The discontinuity may be comprised of a resilient material, which is substantially more flexible than the material which comprises the solepiece or, alternatively, may be comprised of a gap or a groove which is formed in the solepiece.

In another embodiment the discontinuity is comprised of a gap formed in the solepiece by cutting out a portion of the midsole beneath the third, fourth and fifth metatarsal-phalangeal joints. The bottom surface of the solepiece is flexed so that a looped portion thereof extends at least partially into the gap in the midsole. When the foot is flexed during physical exercise, the looped portion is stretched to facilitate the bending of the solepiece.

In a preferred embodiment the footwear is comprised of a running shoe wherein a portion of the midsole approximately 4 cm. in length underlying the joint line between the third, fourth and fifth metatarsalphalangeal joints and 2 cm. wide is removed and replaced with a crepe or spongy rubber material having a durometer reading of less than 10. The bottom surface of the solepiece underlying the third, fourth and fifth metatarsal-phalangeal joints is cut to further enhance the flexing action of the solepiece. The bottom surface of the solepiece is comprised of a hard rubber tread with a plurality of cleats or studs for traction disposed thereon. To reduce wear along the discontinuity of the solepiece and to optimize the flexing action of the solepiece, the cleats or studs are not disposed directly on or immediately adjacent to the discontinuity. To further enhance the flexibility of the shoe of the present invention, additional discontinuities substantially as described above are disposed in the solepiece underlying the third, fourth and fifth interphalangeal joints of the wearer's toes.

In another aspect of the invention a shoe for physical exercise, such as running, jogging or walking, is customized for the individual wearer. The shoe includes a solepiece extending substantially along the entire length of the shoe and an upper piece secured to the solepiece for providing an enclosure for receiving a human foot therein. Disposed between the upper member and solepiece is a corrective member for substantially conforming the shoe to fit the individual wearer's foot. The corrective member provides support for the foot during physical activity. To counteract pronation or supination of the foot during running or jogging, the thickness of the corrective member is adjusted to provide the necessary support on the medial or lateral side of the foot, as the case may be. The disposition of the corrective device between the upper member and the midsole provides more space for the wearer's foot on the inside of the shoe, thereby enhancing comfort and fit, and providing foot support from heel to toe. Alternatively, the corrective member may be disposed inside the foot enclosure of the upper member if the wearer so desires.

In another embodiment the weight of the shoe is reduced without sacrificing foot support by providing a shoe in which the material comprising the solepiece adjacent to the heel of the shoe on the medial side thereof is comprised of a substantially lighter weight material than the material on the lateral side thereof adjacent to the heel. During the running cycle, the runner tends to impact the ground on the lateral side of the heel portion of the shoe. Thus, it is the lateral side of the foot which receives the greater impact and therefore needs the greater support during running. Replacement of the stronger, denser material on the medial side of the shoe with a lighter weight material thus eliminates excess weight without sacrificing foot support and represents a substantially different approach from that used in the conventional shoe wherein the denser material is on the medial side.

In yet another embodiment a customized shoe for physical exercise, such as running, jogging or walking is provided in which a solepiece is comprised of a plurality of materials of selected resiliencies underlying the phalanges and metatarsals of the foot. The materials are arranged so that the least resilient material is disposed on the medial side of the shoe and the most resilient material is disposed on the lateral side of the shoe. Thus, when the solepiece is flexed during exercise, the stronger muscles which operate the first and second metatarsals and phalanges will perform a proportionately greater share of the work than the weaker muscles of the lateral side of the foot. The solepiece is comprised of materials of selected resiliencies disposed beneath the respective metatarsals and phalanges, or, alternatively, segments of these materials of selected resiliency may be disposed beneath the respective joint lines along the metatarsal-phalangeal joints and the interphalangeal joints.

The footwear of the present invention has the advantage of increasing the efficiency of the wearer during running, jogging, walking or other physical activity and reducing the risk of injury to the lower extremities. In addition, the footwear may be customized to fit the individual wearer for greater foot support and control.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
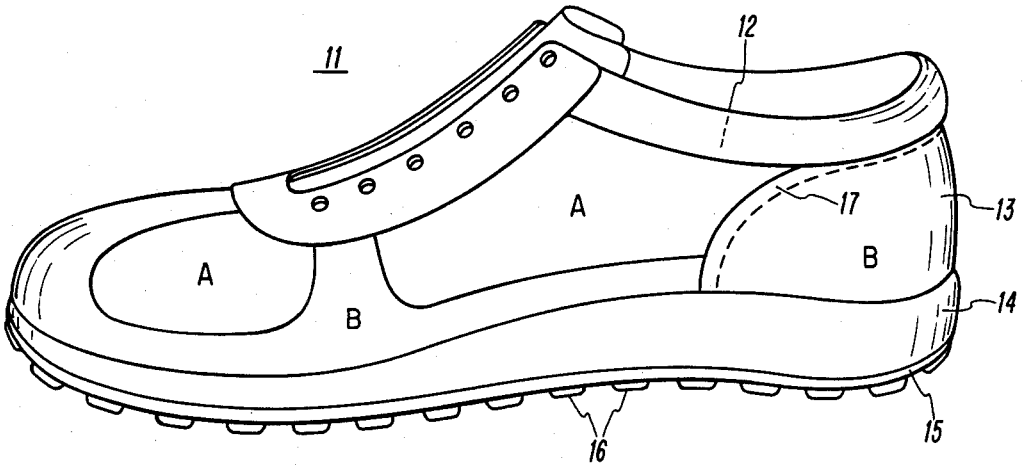
FIG. 1 is a perspective view of a conventional shoe used for running and jogging.

In the description which follows, like parts are marked throughout the specification and drawings with the same reference numerals, respectively. The drawings are not necessarily to scale, and is some instances proportions have been exaggerated to more clearly depict certain features of the invention.

Referring now to FIG. 1, a shoe 11 typically used for running and jogging is comprised of a lightweight upper member 13, which includes an enclosure 12 for enveloping the wearer's foot, a midsole member 14 and a tread member 15. Upper member 13 is preferably comprised of a durable, lightweight material such as nylon in region A and a leather material for added durability and strength in region B of upper member 13.

Midsole member 14 is preferably comprised of a flexible, resilient material such as crepe or rubber for cushioning the shock resulting from the impact of the foot on the ground during physical exercise. Tread material 15 is preferably comprised of a hard rubber material for durability and includes a plurality of cleats or studs 16 for providing traction during physical exercise. Attached to upper member 13 in the heel portion of shoe 11 is a heel counter 17 which is preferably comprised of a light-weight plastic or polypropylene material, for providing comfort and support for the wearer in the heel region.

Figure 2:
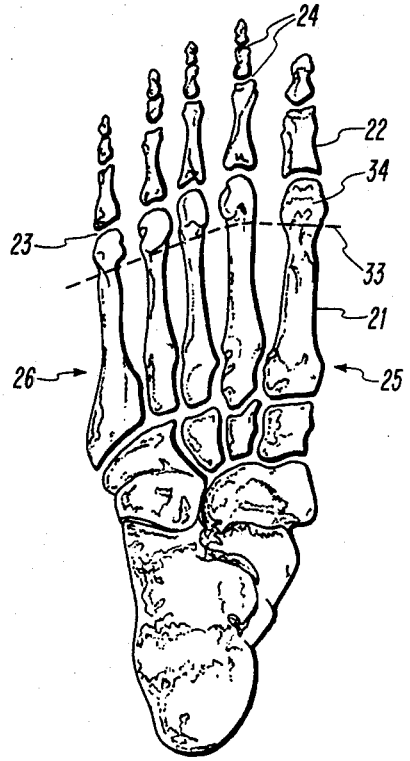
FIG. 2 is a bottom elevational view of the bone structure of the human foot.

Referring to FIG. 2, the bone structure of the human foot is depicted. The metatarsals 21 and phalanges (toes) 22 bones are located at the forward portion of the foot. The discontinuities shown between the respective metatarsals 21 and phalanges 22 represent joints 23, which are commonly referred to as the metatarsal-phalangeal joints. In addition, phalanges 22 include a plurality of interphalangeal joints 24. During the running cycle, the metatarsal-phalangeal joints 23 and the interphalangeal joints 24 tend to allow the foot to flex and push off from the ground. Metatarsal-phalangeal joints 23 are respectively referred to as the first, second, third, fourth and fifth metatarsal-phalangeal joints, moving from the medial (inside) side 25 to the lateral (outside) side 26 of the foot.

Figure 3A:
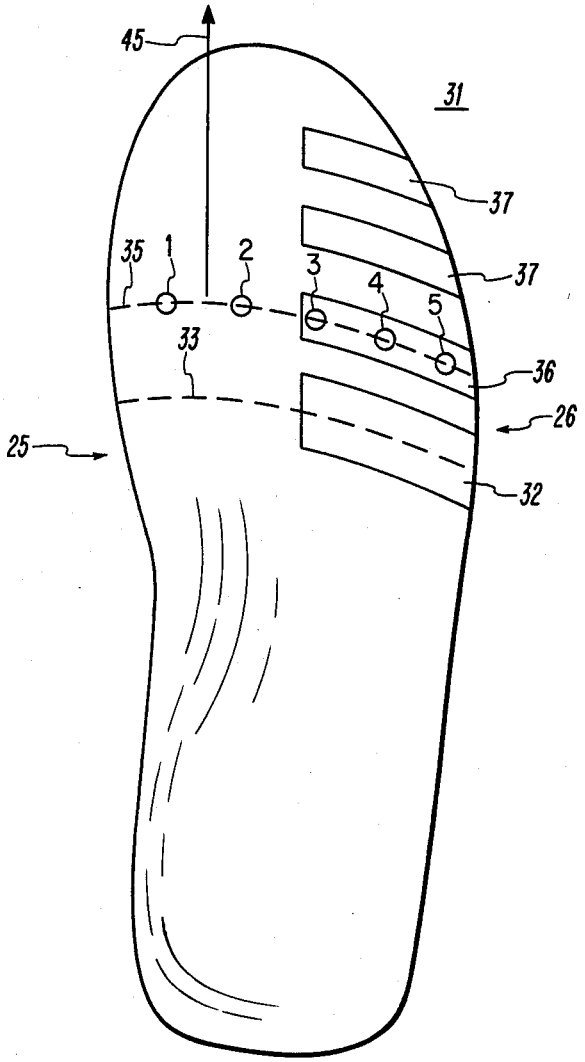
FIG. 3A is a bottom elevational view of a first embodiment of a running shoe according to the present invention.
Figure 3B:
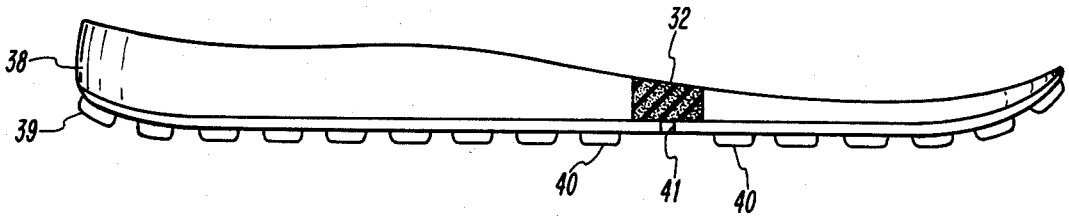
FIG. 3B is a side elevational view of the midsole and tread portions of the running shoe of FIG. 3A.

Referring to FIGS. 3A and 3B, a portion of the midsole and tread of shoe 31 is replaced with a flexible, resilient material 32, such as, for example, a spongy rubber material or crepe having a durometer reading of less than 20. Insert 32 is approximately 4 cm. long by 2 cm. wide and is disposed directly beneath line 33, which is an imaginary line running between the distal ends of the five metatarsal bones 21, at corresponding points just behind the heads 34 of the five metatarsals 21. See also FIG. 2. In the preferred embodiment, insert 32 extends only between the distal ends of the third, fourth and fifth metatarsals 21. The midsole and tread beneath the first and second metatarsals are substantially the same as the remainder of the midsole and tread and preferably have a durometer reading on the order of 40 to 60. Insert 32 provides much greater flexibility on the lateral side 26 of the shoe and facilitates bending of the foot along lateral side 26.

To further enhance the flexibility of lateral side 25 of the shoe, similar inserts 36 and 37 may be included in the tread and midsole of the shoe beneath metatarsal-phalangeal joints 23, represented by imaginary line 35 and beneath interphalangeal joints 24 in the toes and extending along lateral side 26 of the shoe between the respective third, fourth and fifth metatarsal-phalangeal joints and interphalangeal joints. To prevent injury, it is sometimes advisable to have insert 37 extend all the way across the shoe to include the first and second interphalangeal joints as well, particularly if the shoe includes an orthodic piece having a thickness greater than 3/16 inch, which is difficult to bend.

Referring to FIG. 3B, insert 32 extends substantially through the entire thickness of midsole 38. Tread 39 is preferably cut along line 33 between the third, fourth and fifth metatarsals to provide added flexibility for the foot to bend. Cleats 40 are preferably not disposed within ¼ inch of cut 41 so as not to inhibit the bending action of the foot. In an alternative embodiment, insert 32 extends substantially through the entire thickness of tread 39 as well as midsole 38 or another insert similar to insert 32 is disposed in tread 39, thereby eliminating the need for cut 41.

Figure 4:
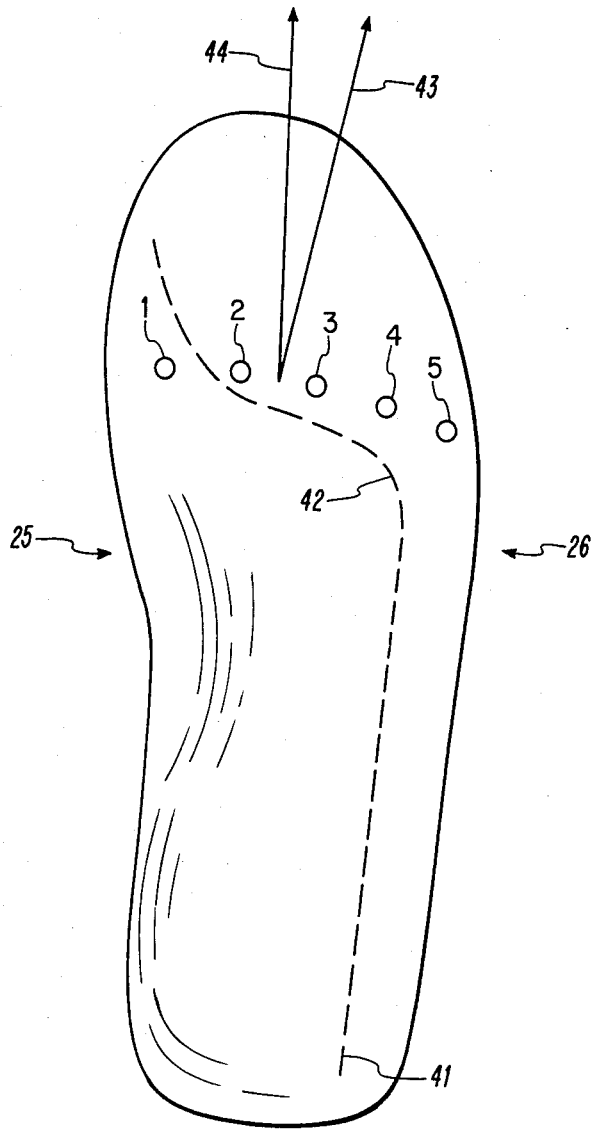
FIG. 4 is a bottom elevational view of a running shoe showing the forces acting on the shoe during the running cyle.

Referring also to FIG. 4, the individual metatarsal-phalangeal joints 23 are respectively represented by numbers 1–5. During the running cycle, the foot tends to hit on the lateral side of the heel, at or near point 41. As the weight is shifted toward the front of the foot for push-off from the ground, the weight tends to shift forward and across the foot from lateral side 26 to medial side 25, as indicated by the dotted line. The foot begins to push off from the ground at approximately point 42 when the weight is still substantially on lateral side 26 of the foot. In addition, the fifth metatarsal-phalangeal joint 5 is usually located substantially rearward of the first and second joints 1 and 2. As a result, the muscles which operate the third, fourth and fifth metatarsals and phalanges provide the initial thrust for push-off from the ground and for bending the foot and shoe along the respective joint lines.

In addition to the problem of fatiguing the muscles in the lateral side of the foot, the foot tends to rotate outwardly from the desired direction of running because the thrust generated by the third, fourth and fifth metatarsal-phalangeal joints 3, 4 and 5 tends to move the foot in a direction indicated by arrow 43 instead of the desired direction indicated by arrow 44. The outward rotation of the foot during running is of course greater in some runners than others, but in all cases the efficiency of the running stride and hence the speed of the runner are reduced.

Referring again to FIG. 3A, when inserts 32, 36 and 37 are disposed in midsole 38 along the respective joint lines, the flexor muscles on lateral side 26 of the foot will cause the heel to rise up, but will not bend shoe 31 sufficiently for effective push-off from the ground because of the presence of the light-weight, flexible inserts 32, 36 and 37 at the natural bending points. As a result, the flexor muscles on medial side 25 of the foot, which operate the first and second metatarsal-phalangeal joints 1 and 2 are forced to do the work to bend the shoe for effective lift-off from the ground. Thus, push-off is accomplished from medial side 25 of shoe 31 instead of from lateral side 26 as in conventional shoes. This not only allows the stronger flexor muscles of medial side 25 to do the primary share of the work and thus reduce muscle fatigue in the foot, but also tends to move the foot in a direction indicated by arrow 44, which is substantially closer to the desired direction of running than in conventional shoes. Thus, the efficiency of the runner's stride is substantially improved with a concomitant improvement in his effective running speed.

Figure 5A:
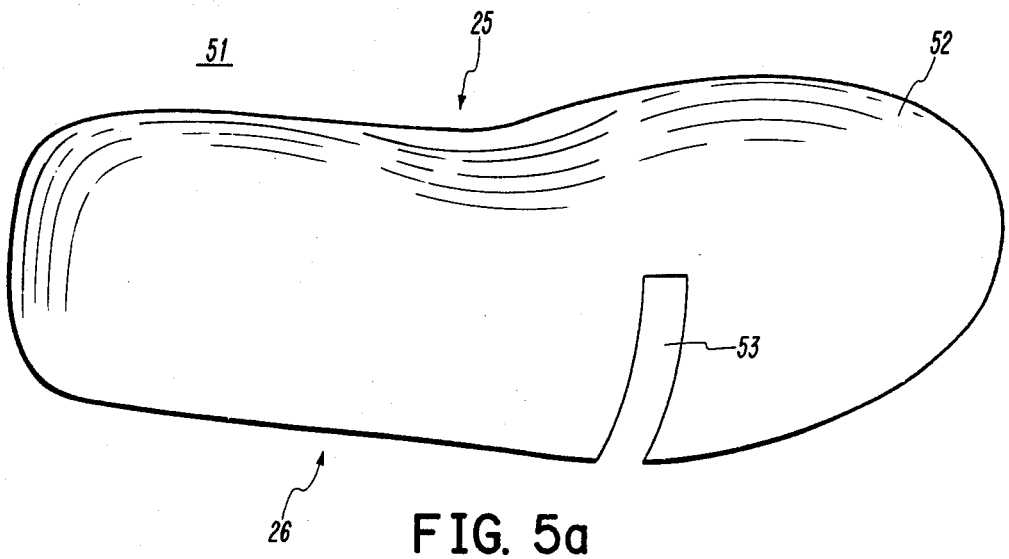
FIG. 5A is a bottom elevational view of a second embodiment of a running shoe according to the present invention.
Figure 5B:
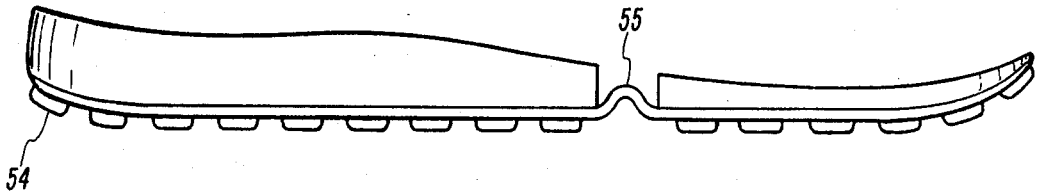
FIGS. 5B and 5C are side elevational views of the midsole and tread portions of the running shoe of FIG. 5A.
Figure 5C:
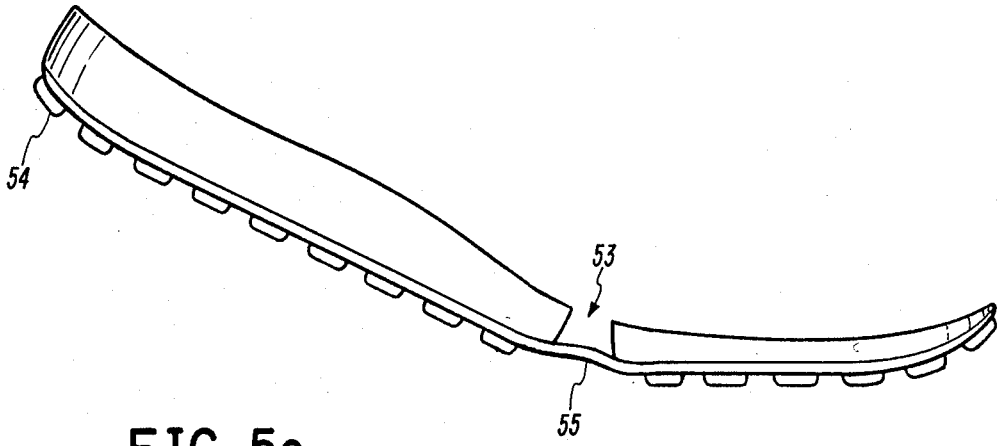

The aforementioned improvements may also be achieved using the embodiments described in FIGS. 5 and 6. Referring to FIGS. 5A, 5B, and 5C, running shoe 51 has a portion of its midsole 52 removed to provide an opening 53. Opening 53 is approximately 1 cm. wide and 4 cm. long extending along lateral side 25 of the shoes beneath the distal heads of third, fourth and fifth metatarsals 21. Referring also to FIG. 5B, tread 54 is bunched to provide a folded portion 55, which is received within opening 53. Thus, when the heel of the foot rises up during the running cycle, as depicted in FIG. 5C, tread 54 stretches to allow the portion of shoe 51 between the heel and opening 53 to flex independently of the portion of shoe 51 between the toe and opening 53, thereby transferring the primary workload for push-off from the ground to medial side 25 of shoe 51 as described above.

Figure 6A:
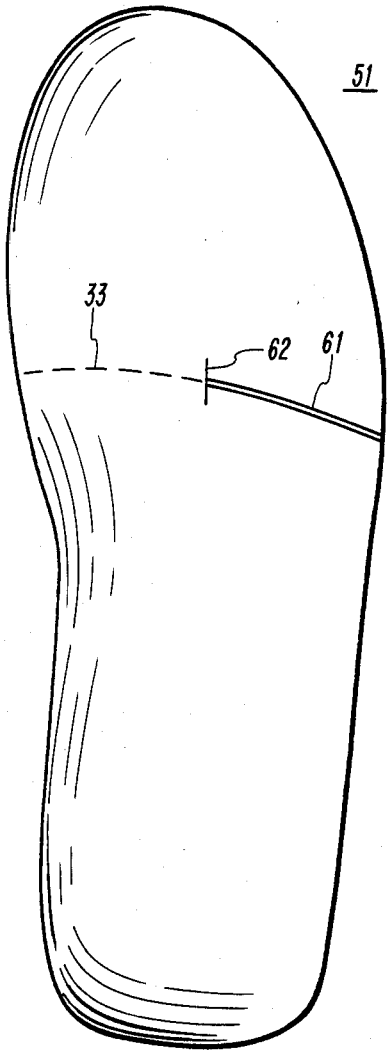
FIG. 6A is a bottom elevational view of a third embodiment of a running shoe according to the present invention.
Figure 6B:
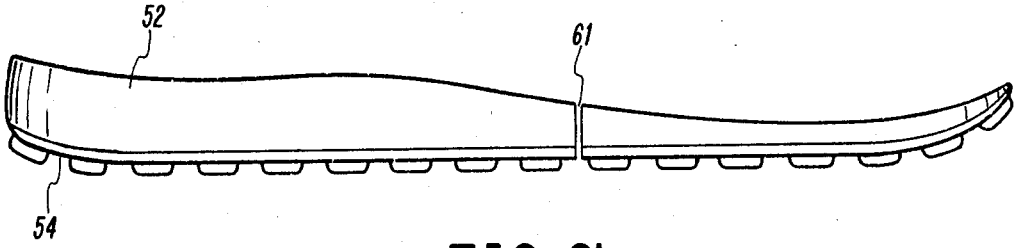
FIG. 6B is a side elevational view of the midsole and tread portions of the running shoe of FIG. 6A.

Another embodiment is depicted in FIGS. 6A and 6B. Referring to FIGS. 6A and 6B, a small cut 61 is made in shoe 51 along lateral side 26 thereof. Cut 61 extends through substantially the entire thickness of midsole 52 and tread 54 and along a line connecting the distal ends of the third, fourth and fifth metatarsals 21, as depicted by line 33 in FIG. 2. It is advisable to provide a reinforcing material at point 62 in midsole 52 and tread 54 or alternatively to make a transverse cut at right angles to the major axis of cut 61 to prevent cut 61 from migrating farther toward medial side 25 of shoe 51 during wear.

One skilled in the art will appreciate that the footwear of the present invention, which includes the embodiments described in connection with FIGS. 4, 5 and 6 has the advantage of significantly improving the efficiency of the stride of an individual during running, jogging or walking. By providing a discontinuity in the midsole and tread of the shoe beneath the natural flexion points of the foot on the lateral side thereof, the stronger muscles on the medial side of the foot are isolated to provide the primary thrust for lift-off of the foot during running, jogging or walking, thereby increasing the efficiency of the wearer's stride and reducing the risk of overfatigue and injury to the weaker muscles on the lateral side of the foot.

Another aspect of the present invention is illustrated in FIGS. 7–10. Referring to FIG. 7A, a shoe 71 is customized to fit the individual wearer. The material in regions 721 of the midsole and tread of shoe 71 is comprised of a conventional material used for the midsole and tread regions of a running shoe, as described above with reference to FIG. 1. In regions 722, 723, 724 and 725, the midsole and tread are comprised of more flexible, resilient materials than that used in region 721, preferably materials having durometer reading less than 40. The respective resilient materials are chosen to balance the work done by the muscles in the foot during physical exercise so that the foot muscles do a proportional share of the work commensurate with their relative strengths.

For example, if the foot muscles which flex the third metatarsalphalangeal joint 3 are determined to be approximately 60% as strong as the comparable muscles which flex the first metatarsal-phalangeal joint 1, then the resistance in the material comprising the midsole and tread in region 723 is chosen to provide 60% as much resistance to the bending action of the shoe as the material in region 721. The result is that each group of muscles in the foot does its proportional share of the work in flexing the foot and bending the shoe during lift-off from the ground during the running cycle. Regions 722, 723, 724 and 725 extend from the respective distal heads of metatarsals of the second, third fourth and fifth metatarsals 21 forward to the forward-most portion of shoe 71 and are of sufficient width to envelop the respective metatarsal-phalangeal joints 23 and interphalangeal joints 24.

Figure 7A:
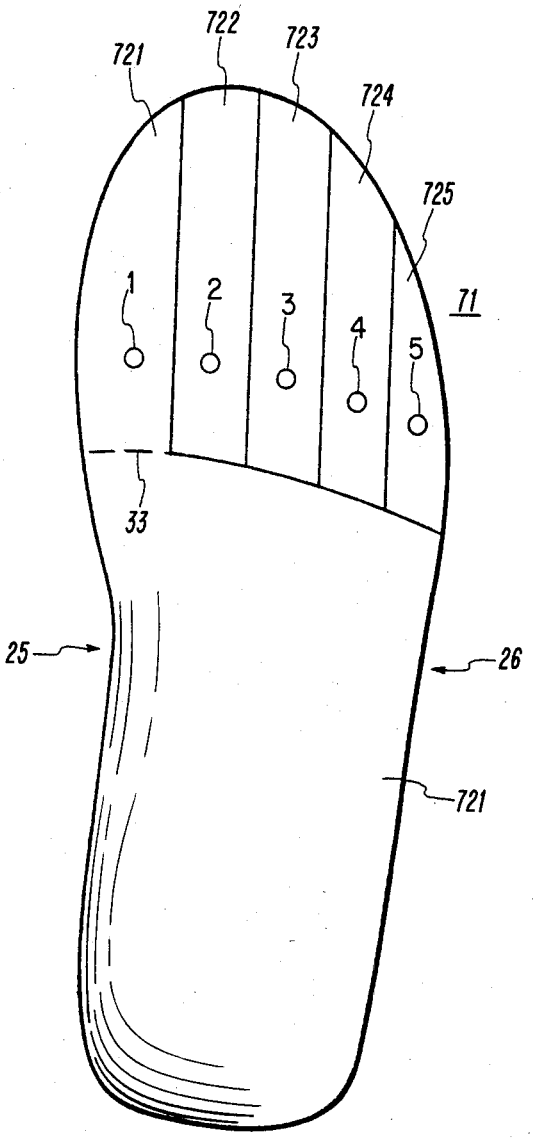
FIG. 7A is a bottom elevational view of a fourth embodiment of the running shoe according to the present invention.
Figure 7B:
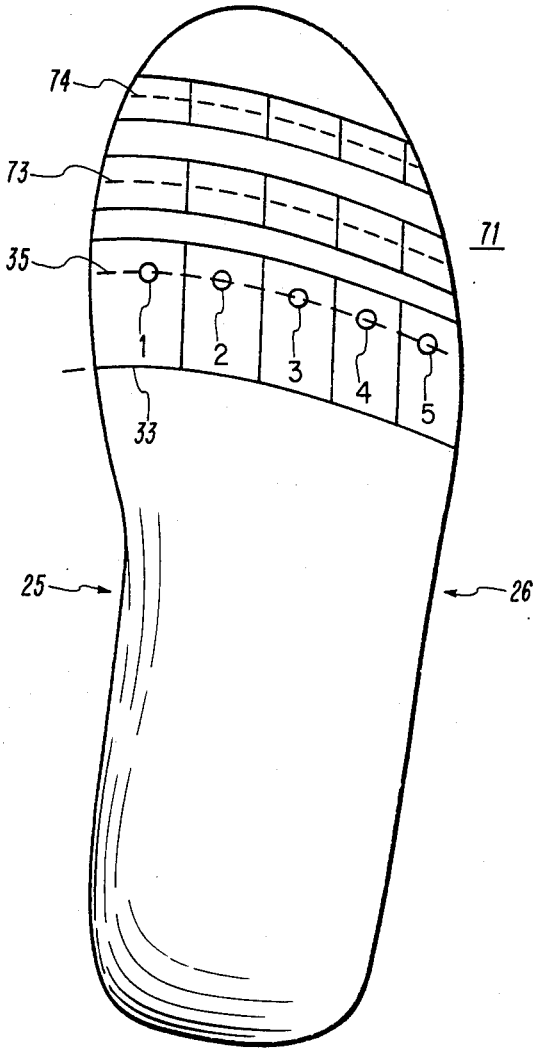
FIG. 7B is a bottom elevational view of a fifth embodiment of a running shoe according to the present invention.

Another embodiment is illustrated in FIG. 7B wherein the midsole and tread of shoe 71 has disposed at selected locations therein materials which are substantially more flexible and resilient than the remainder of the material used in the midsole and tread. Such resilient materials are disposed along the metatarsal-phalangeal joint line 35 and the interphalangeal joint lines 73 and 74 to facilitate the bending of the foot and shoe 71 along the natural joint lines. As in the embodiment shown in FIG. 7A, the resiliencies of the materials disposed on lateral side 26 of shoe 71 are greater than the resiliencies of the materials disposed on medial side 25 of shoe 71, so that the foot muscles do their respective proportional shares of the work in bending the foot and pushing off from the ground during physical exercise. It will be appreciated by one skilled in the art that the relative resiliencies of the flexible materials used in the embodiments shown in FIG. 7A and 7B are based on the results of biomechanical testing of each individual's foot muscles and unique foot characteristics.

Referring to FIG. 8, a customized shoe 81 in accordance with the present invention is depicted. Shoe 81 includes an othodic member 82 disposed between upper member 83 and midsole 84. Orthodic 82 is formed in the conventional fashion by making a casting of the individual's foot and providing a support piece to fit the contours and shape of the foot. Typically, an orthodic is placed inside the shoe cavity to provide the needed support for the individual's foot. Orthodic inserts are often used for a variety of foot abnormalities, including excessive pronation (inward turning of the foot), supination (outward turning of the foot), excessively high arches or flat feet.

Conventional orthodic pieces have several disadvantages. One disadvantage is that the orthodic piece is typically worn inside the shoe, which often does not leave sufficient room for the foot inside the shoe and causes the heel to rise up and out of the shoe during physical exercise. Another disadvantage is that because of space limitations inside the shoe the convention orthodic piece extends from the heel to a point just behind the distal heads of the metatarsals. Thus, support for the toes is generally lacking.

Figure 8A:
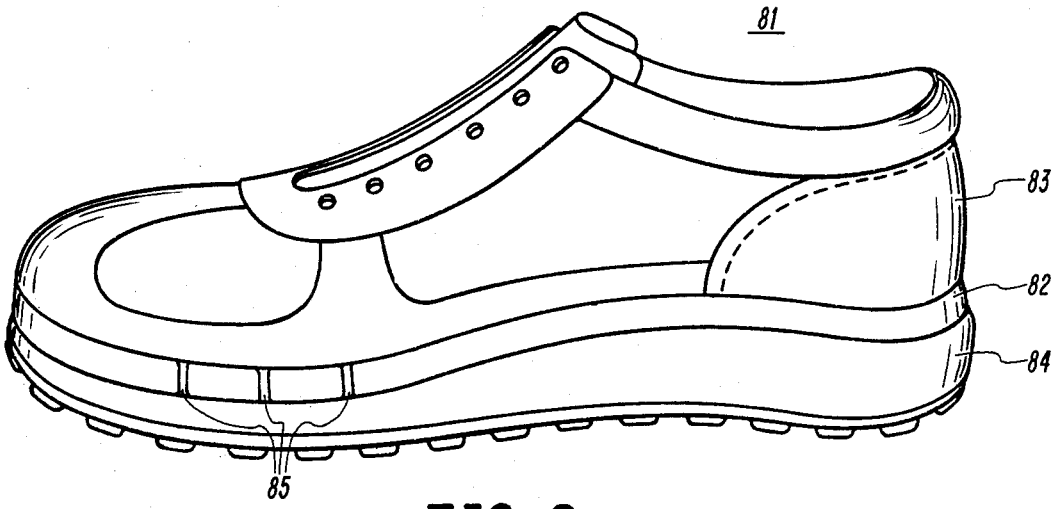
FIG. 8A is a side elevational view of a sixth embodiment of a running shoe according to the present invention.
Figure 8C:
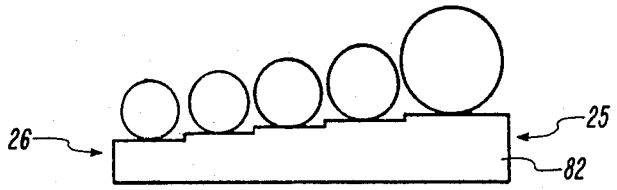
FIG. 8C is a front elevational view of a customized orthodic piece according to the present invention.
Figure 8B:
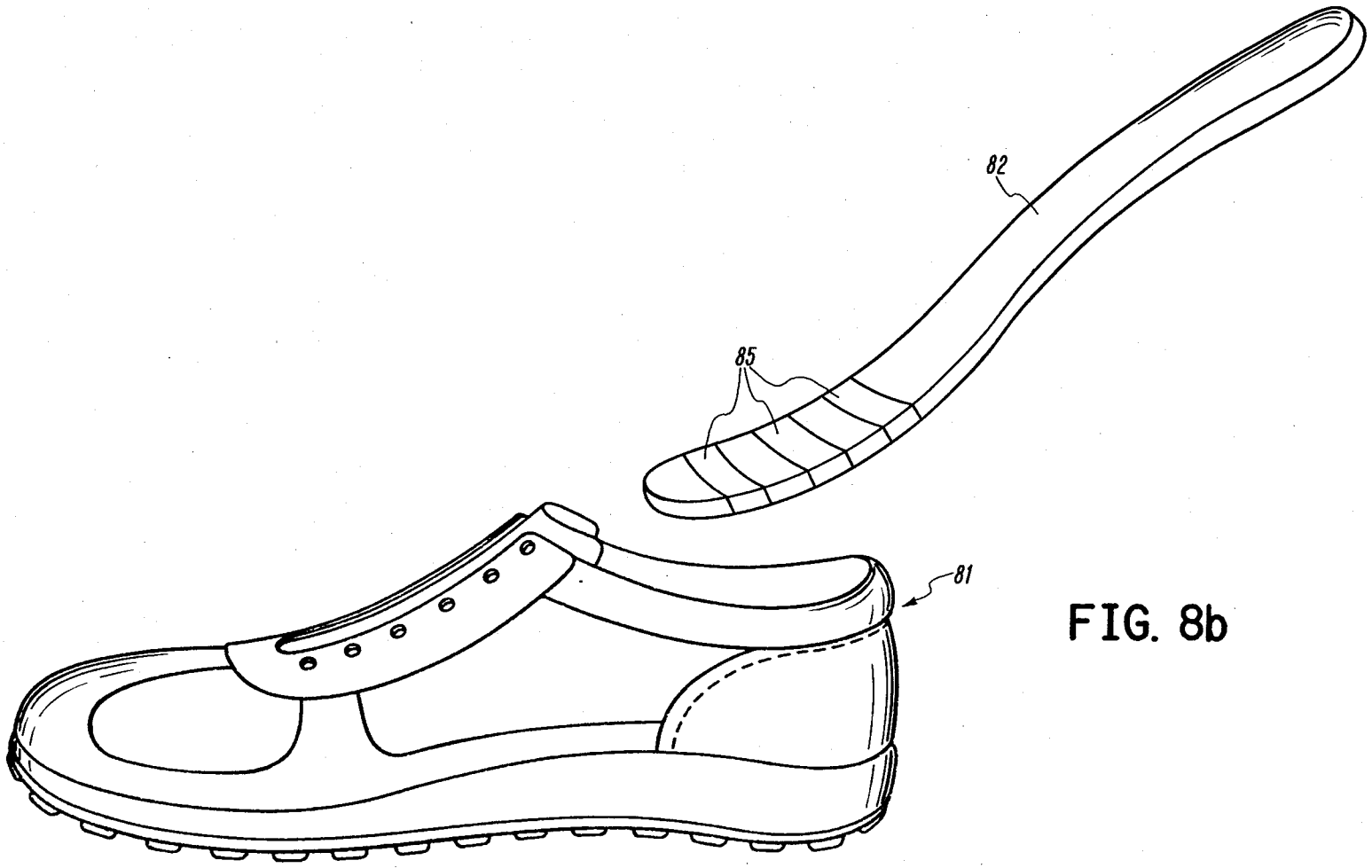
FIG. 8B is a perspective view of a customized orthodic piece according to the present invention to be received inside of a running shoe.

By placing the orthodic on the outside of shoe 81, in accordance with the present invention as shown in FIG. 8A, proper support can be provided without cramping the foot inside the shoe. In addition, cuts 85 are made in orthodic member 82 beneath the metatarsal-phalangeal joints 23 and beneath the interphalangeal joints 24 to facilitate flexing of the foot. Alternatively, if the individual so desires orthodic member 82 may be disposed inside of shoe 81 instead of between upper member 83 and midsole 84, as depicted in FIG. 8B.

A common problem experienced by runners is that of excessive pronation, which results from the excessive rotation of the foot toward the medial side during the running cycle. By making orthodic member 82 substantially thicker on the medial side, as shown in FIG. 8C, excessive pronation is thereby counteracted and the risk of injury reduced. The foot support provided by orthodic member 82 allows other improvements to be made in footwear used in physical exercise. One skilled in the art will appreciate that orthodic 82 can be structured to counteract foot problems other than pronation, such as, for example, supination, flat feet and high arches.

Figure 9:
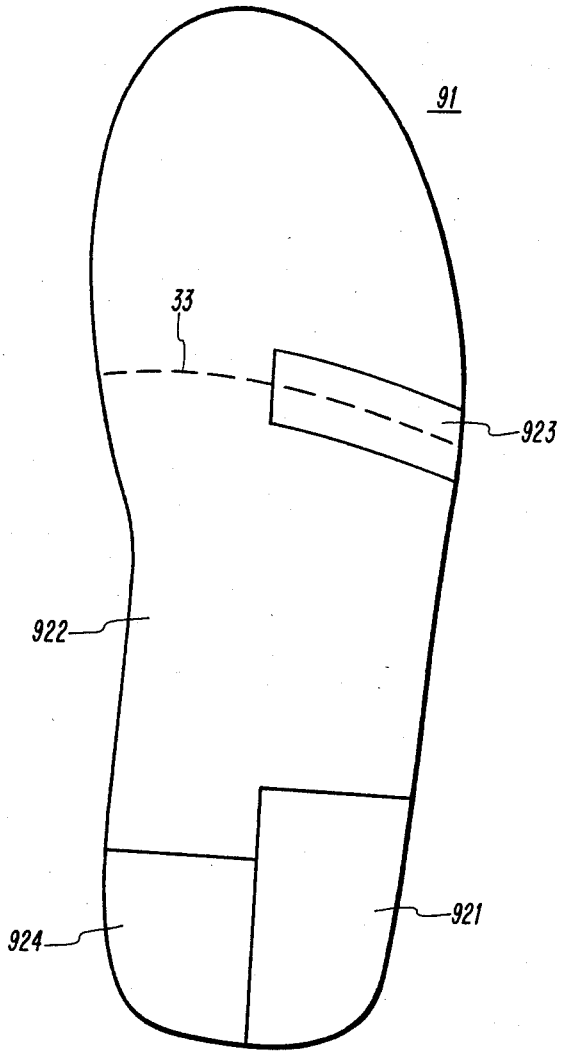
FIG. 9 is a bottom elevational view of an eighth embodiment of the running shoe according to the present invention.

Referring to FIG. 9, the midsole and tread of shoe 91 includes a relatively rigid material having a durometer reading on the order of 40–60, such as, for example, a polyurethane material, in region 921 on the lateral side of shoe 91 to provide stability during the running cycle. Region 921 extends in a longitudinal direction from the heel of the shoe forward approximately 2 ½ inches and in a transverse direction across approximately half the width of the shoe. Because of the support provided by orthodic member 82, the material in region 922 of the tread and midsole may be comprised of a much lighter weight material having a durometer reading on the order of 20–40, such as, for example, an EVA-type material, thereby reducing the overall weight of the shoe and enhancing running performance. The midsole and tread in region 923 are comprised of a resilient material having a durometer reading of 20 or less and is disposed in the region of the metatarsals and phalanges on the lateral side of the shoe, as has been described with reference to FIGS. 2–6. To further enhance stability in the heel region of shoe 91, a relatively dense material, such as, for example, polyurethane, is disposed in region 924 on the medial side of shoe 91. The material comprising region 924 preferably has a density between the respective densities of the materials in regions 921 and 922, i.e. a durometer reading of approximately 40.

Various embodiments of the invention have now been described in detail. Since it is obvious that many changes and modifications can be made in the above details without departing from the nature and spirit of the invention, it is understood that the invention is not to be limited to said details, except as set forth in the appended claims.

What is claimed is:

1. A shoe for physical exercise comprising:

a solepiece extending substantially along the entire length of said shoe, said solepiece including a ground-engaging tread portion and a midsole portion for providing support for the wearer's foot;

an upper member secured to said solepiece and having an enclosure for receiving the foot therein;

said solepiece further including a discontinuity therein extending horizontally from the lateral side of the shoe inwardly to a predetermined position and vertically through substantially the entire midsole portion and tread portion for being disposed substantially beneath selected ones of the metatarsal bones of the wearer's foot, to enhance flexure of said midsole portion and tread portion as the wearer's foot flexes during physical exercise.

2. The shoe according to claim 1 wherein said discontinuity is comprised of at least one insert of resilient material which is substantially more flexible than the material from which the remainder of the solepiece is comprised.

3. The shoe according to claim 2 wherein said at least one insert is comprised of a spongy rubber material having a durometer reading of 20 or less.

4. The shoe according to claim 1 wherein said solepiece includes a first discontinuity therein for being disposed substantially beneath the distal heads of the third, fourth and fifth metatarsal bones and a second discontinuity therein for being disposed substantially beneath the third, fourth and fifth metatarsal-phalangeal joints on the lateral side of the foot.

5. The shoe according to claim 4 wherein said solepiece further includes a third discontinuity for being disposed substantially beneath the respective third, fourth and fifth interphalangeal joints on the lateral side of the foot.

6. The shoe according to claim 5 wherein said first, second and third discontinuities are comprised of respective first, second and third inserts of resilient materials which are substantially more flexible than the material which comprises the remainder of the solepiece.

7. The shoe according to claim 1 wherein said discontinuity is comprised of an opening in said solepiece, said opening extending from the lateral side of the shoe to a predetermined position inwardly from said lateral side, for being disposed substantially beneath the distal heads of the third, fourth and fifth metatarsal bones on the lateral side of the wearer's foot.

8. The solepiece according to claim 1 wherein said midsole portion includes a corrective member which substantially conforms to the size and shape of the bottom portion of the individual wearer's foot to enhance foot support.

9. The solepiece according to claim 8 wherein said corrective member includes at least one cut extending from the lateral side inwardly to a predetermined position, for being disposed substantially beneath the distal heads of the third, fourth and fifth metatarsal bones of the wearer's foot to facilitate flexing thereof during the running cycle.

10. A solepiece for an athletic shoe or the like, comprising:

a ground-engaging bottom surface;

a midsole portion for providing foot support; and a discontinuity disposed therein extending horizontally from the lateral side of the solepiece inwardly to a predetermined position and vertically through substantially the entire midsole portion and bottom surface for being disposed substantially beneath the selected ones of the metatarsal bones of the wearer's foot, to enhance flexure of said solepiece along with the wearer's foot during physical exercise.

11. The solepiece according to claim 10 wherein said selected metatarsal bones bones are the distal heads of the third, fourth and fifth metatarsal bones.

12. The solepiece according to claim 10 wherein said midsole portion includes a corrective member which substantially conforms to the size and shape of the bottom portion of the individual wearer's foot to enhance foot support.

13. The solepiece according to claim 12 wherein said corrective member includes at least one cut extending from the lateral side inwardly to a predetermined position, for being disposed substantially beneath the distal heads of the third, fourth and fifth metatarsal bones of the wearer's foot to facilitate flexing thereof during the running cycle.

14. A shoe for physical exercise comprising:

a solepiece extending substantially along the entire length of said shoe, said solepiece including a ground-engaging bottom surface and a midsole portion for providing support for the wearer's foot;

an upper member secured to said solepiece and having an enclosure for receiving the foot therein;

said solepiece further including at least one insert of resilient material which is substantially more flexible than the material from which the remainder of the solepiece is comprised, said at least one insert being disposed in said midsole portion and extending from the lateral side of the shoe inwardly to a predetermined position for being disposed substantially beneath selected ones of the metatarsal bones of the wearer's foot, the bottom surface of said solepiece having at least one cut substantially underlying said at least one insert, said at least one insert and said at least one cut for enhancing the flexure of said solepiece along with the wearer's foot during physical exercise.

15. The shoe according to claim 14 wherein said at least one insert is comprised of first, second and third inserts disposed in said midsole portion of said solepiece and said bottom surface of said solepiece includes respective first, second and third cuts substantially underlying said first, second and third inserts, respectively, said first insert being disposed substantially beneath the distal heads of the third, fourth and metatarsal bones, said second insert being disposed substantially beneath the third, fourth and fifth metatarsal-phalangeal joints and said third insert being disposed substantially beneath the respective third, fourth and fifth interphalangeal joints on the lateral side of the foot.

16. The shoe according to claim 15 wherein the bottom surface includes a plurality of cleats disposed thereon for providing traction during physical exercise, said cleats being arranged on said bottom surface so that none of said cleats are disposed beneath or substantially adjacent to said cuts in said bottom surface.

17. A shoe for physical exercise comprising:

a solepiece extending substantially along the entire length of said shoe, said solepiece including a ground-engaging bottom surface and midsole portion for providing support for the wearer's foot;

an upper member secured to said solepiece and having an enclosure for receiving the foot therein;

said solepiece having an opening extending from the lateral side of the shoe through a predetermined position inwardly from said lateral side for being disposed substantially beneath the distal heads of the third, fourth and fifth metatarsal bones on the lateral side of the wearer's foot, said opening being located in said midsole portion and the bottom portion including a looped portion extending at least partially into said opening so that the looped portion is extended as the wearer's foot flexes during physical exercise.

18. A solepiece for an athletic shoe or the like, comprising:

a ground-engaging bottom surface;

a midsole portion for providing foot support; and said solepiece including materials of selected resiliencies for being disposed substantially beneath the distal heads of the first, second, third, fourth and fifth metatarsal bones and substantially beneath the respective joint lines of the metatarsal-phalangeal joints and the interphalangeal joints, said resilient materials having respective predetermined resiliencies to provide greater resiliency and flexibility on the lateral side of the solepiece than on the medial side thereof, to enhance flexure of said solepiece along with the wearer's foot during physical exercise.

19. The solepiece according to claim 18 wherein said resilient materials extend from the distal heads of the first, second, third, fourth and fifth metatarsal bones forwardly to the toe region of the solepiece, selected ones of said resilient materials being substantially more flexible than the material from which said solepiece is comprised rearwardly of the distal heads of the first, second, third, fourth and fifth metatarsal bones.

* * * * *